US012729507B1

(12) United States Patent
Gustafson

(10) Patent No.: US 12,729,507 B1
(45) Date of Patent: Sep. 8, 2026

(54) PUSH BLADE ATTACHMENT BRACKET

(71) Applicant: THOR INTERTECH LLC, Fall Creek, WI (US)

(72) Inventor: John E. Gustafson, Fall Creek, WI (US)

(73) Assignee: Thor Intertech LLC, Fall Creek, WI (US)

( * ) Notice: Subject to any disclaimer, the term of this patent is extended or adjusted under 35 U.S.C. 154(b) by 399 days.

(21) Appl. No.: 18/351,837

(22) Filed: Jul. 13, 2023

Related U.S. Application Data

(60) Provisional application No. 63/368,414, filed on Jul. 14, 2022.

(51) Int. Cl.
*E02F 3/96* (2006.01)
*E02F 3/32* (2006.01)

(52) U.S. Cl.
CPC ..... *E02F 3/962* (2013.01); *E02F 3/32* (2013.01)

(58) Field of Classification Search
CPC . E02F 3/962; E02F 3/325; E02F 3/964; E02F 3/3686; E02F 3/963; E02F 3/961; A01B 59/062
See application file for complete search history.

(56) References Cited

U.S. PATENT DOCUMENTS 2,613,912 A * 10/1952 Jordan ..... E04H 17/261 D15/24
2,896,343 A * 7/1959 Raby ..... E02F 3/8152 37/446
3,526,329 A * 9/1970 Stedman ..... E02F 3/961 414/697
3,794,195 A * 2/1974 Clevenger ..... E02F 3/3631 414/723
3,984,016 A * 10/1976 Kuhn ..... E02F 3/3672 414/815
5,098,252 A * 3/1992 Sheesley ..... E02F 3/3686 403/324
5,367,796 A * 11/1994 Bowers ..... E02F 3/4075 37/410
5,806,607 A * 9/1998 Sanders ..... E02F 3/962 172/253
6,499,934 B1 * 12/2002 Kaczmarski ..... E02F 3/3668 37/468
6,619,906 B2 * 9/2003 Dick ..... E02F 3/3668 37/468
6,804,903 B1 * 10/2004 Cooper ..... E02F 9/24 37/352
7,089,692 B2 * 8/2006 Strait ..... E01H 5/063 37/231
7,108,475 B1 * 9/2006 Gustafson ..... A01D 87/122 280/416.2

(Continued)

*Primary Examiner* — Jamie L Mcgowan

(74) *Attorney, Agent, or Firm* — Sherrill Law Offices, PLLC; Michael Sherrill

(57) ABSTRACT

An attachment bracket for use in operationally attaching an earth-moving tool to a push blade on an excavator. The attachment bracket presents an open cavity in the rearward face for accommodating insertion of the push blade into the cavity for hanging attachment of the attachment bracket onto the push blade, and attachment fixtures accessible from the forward face operable for operational engagement with a quick coupler or earth-moving tool.

19 Claims, 19 Drawing Sheets

(56) References Cited

U.S. PATENT DOCUMENTS 8,024,875 B2 * 9/2011 Wetzel ..... E02F 3/964
37/468
8,763,226 B1 * 7/2014 Gustafson ..... E02F 3/3668
29/283
9,809,945 B1 * 11/2017 Middleton ..... E02F 3/964
9,896,821 B1 * 2/2018 Rutledge ..... E02F 3/407
11,105,064 B2 * 8/2021 Smith ..... E02F 3/3686
11,280,057 B2 * 3/2022 Seifert ..... E02F 3/3627
2005/0279980 A1 * 12/2005 Leitner ..... B66C 1/10
254/323
2007/0124964 A1 * 6/2007 Wetzel ..... E02F 3/964
37/468
2007/0134081 A1 * 6/2007 Seabolt ..... E02F 3/3636
414/723
2012/0207576 A1 * 8/2012 Kraft ..... E02F 3/962
414/785
2014/0283422 A1 * 9/2014 Cloutier ..... E02F 3/3618
280/504
2014/0317967 A1 * 10/2014 Parker ..... E02F 3/364
37/403
2015/0027340 A1 * 1/2015 Harman ..... E02F 9/022
105/136
2015/0042113 A1 * 2/2015 Cloutier ..... E02F 3/3618
294/68.1
2015/0107137 A1 * 4/2015 Humphrey ..... E02F 3/78
37/406
2015/0267377 A1 * 9/2015 Whipple ..... E01H 5/061
403/374.1
2016/0289918 A1 * 10/2016 Waldner ..... E02F 3/402
2017/0089036 A1 * 3/2017 Parker ..... E02F 3/3695
2018/0362098 A1 * 12/2018 Staal ..... B62D 21/186
2019/0054823 A1 * 2/2019 Kirchmair ..... E02F 9/2016
2021/0206308 A1 * 7/2021 Broizat ..... B62D 55/06
2021/0207339 A1 * 7/2021 Nakatani ..... E02F 3/845
2023/0183942 A1 * 6/2023 Tamura ..... E02F 9/26
715/771
2023/0287651 A1 * 9/2023 Sharp ..... E02F 3/7631
2025/0179769 A1 * 6/2025 Yoshida ..... E02F 9/0866
2025/0290283 A1 * 9/2025 Muraoka ..... B60K 35/22

* cited by examiner

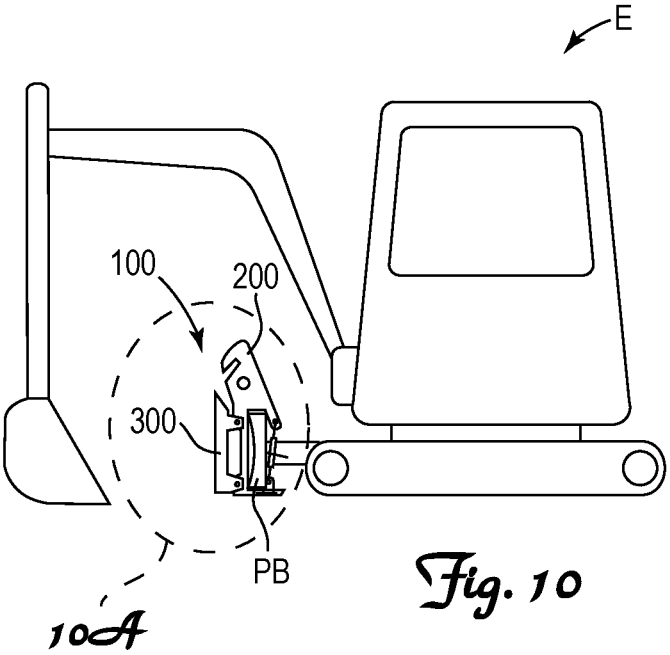
Fig. 10
Fig. 10A
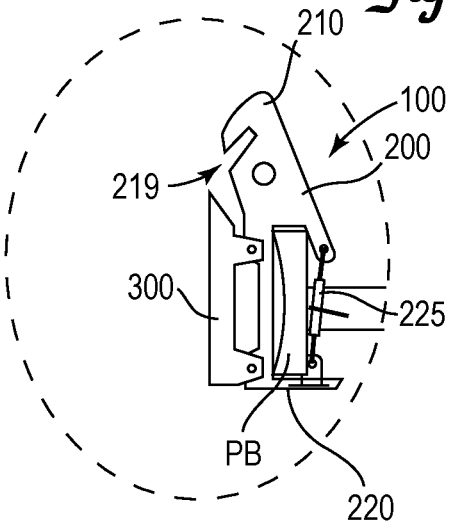

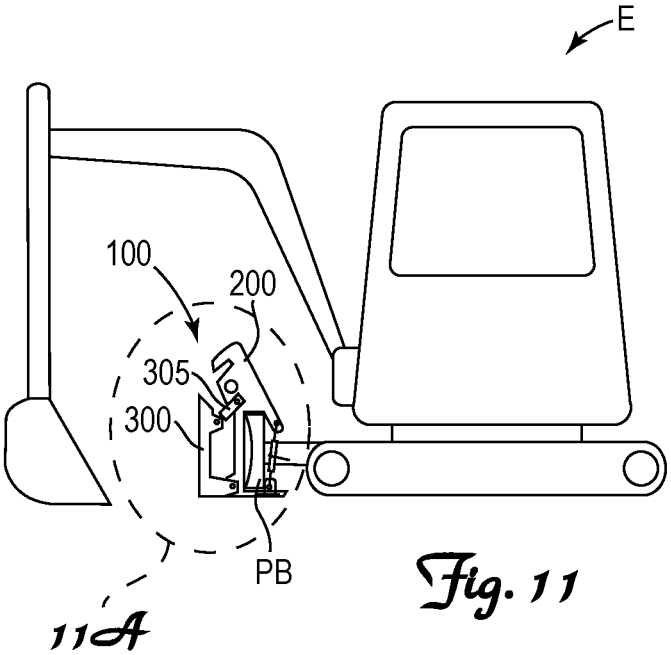
Fig. 11
Fig. 11A
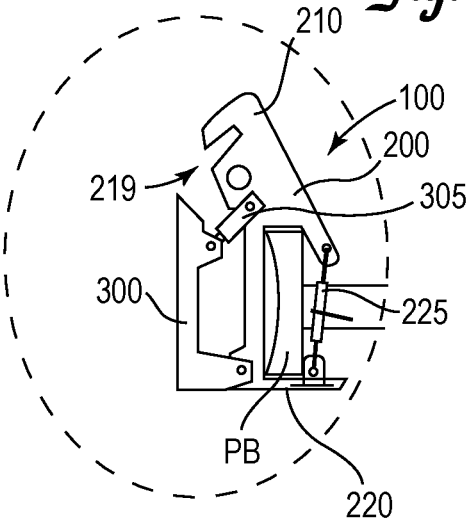

PUSH BLADE ATTACHMENT BRACKET

BACKGROUND

Excavators, including heavy-duty, compact and mini excavators, are typically equipped with a push blade for pushing and leveling earth. These push blades are usually equipped for hydraulic lift (i.e., pivoting up and down about a lateral axis relative to the chassis of the excavator) and optionally equipped for hydraulic angle adjust (i.e., pivoting left and right about a transverse or vertical axis).

A need exists for a device that provides functional attachment of various earth-moving tools (e.g., a bucket) to the push blade on an excavator for increasing versatility of the excavator. The device preferably provides for hydraulic tilt of an attached earth-moving tool (i.e., pivoting of the earth-moving tool about a lateral axis relative to the extension arm of the push blade for changing the vertical angle of an attached earth-moving tool relative to ground).

SUMMARY OF THE INVENTION

A first aspect of the invention is an attachment bracket for use in operationally attaching an earth-moving tool to a push blade on an excavator. The attachment bracket has forward and rearward faces and presents (i) an open cavity in the rearward face for accommodating insertion of the push blade into the cavity for hanging attachment of the attachment bracket onto the push blade, and (ii) attachment fixtures accessible from the forward face operable for operational engagement with the earth-moving tool.

A second aspect of the invention is an adapter bracket for use in operationally attaching a earth-moving tool to a push blade on an excavator. The adapter bracket includes an attachment bracket and a quick coupler. The attachment bracket has forward and rearward faces and presents an open cavity in the rearward face for accommodating insertion of the push blade into the cavity for hanging attachment of the bracket onto the push blade. The quick coupler is secured to the forward face of the attachment bracket and has a top beveled edge operable for insertion into a downwardly open channel extending from a rearward face of the earth-moving tool for accommodating insertion of the upper beveled edge into the channel for hanging attachment of the earth-moving tool onto the quick coupler.

A third aspect of the invention is an excavator equipped with the first and/or second aspects of the invention.

A particular embodiment of the third aspect of the invention further includes an earth-moving tool extending from an end of the undercarriage of the excavator opposite the attachment bracket or adapter bracket, with that earth-moving tool having powered lift and tilt functionality.

BRIEF DESCRIPTION OF THE DRAWINGS

FIG. 10 is a side view of the excavator depicted in FIG. 8 with one embodiment of a quick coupler pinned to the attachment bracket.

FIG. 10A is an enlarged side view of the push blade, attachment bracket and quick coupler depicted in FIG. 10.

FIG. 11 is a side view of the excavator depicted in FIG. 8 with one embodiment of a quick coupler tiltably pinned to the attachment bracket.

FIG. 11A is an enlarged side view of the push blade, attachment bracket and quick coupler depicted in FIG. 11.

DETAILED DESCRIPTION OF A PREFERRED EMBODIMENT

Definitions

Figure 1:
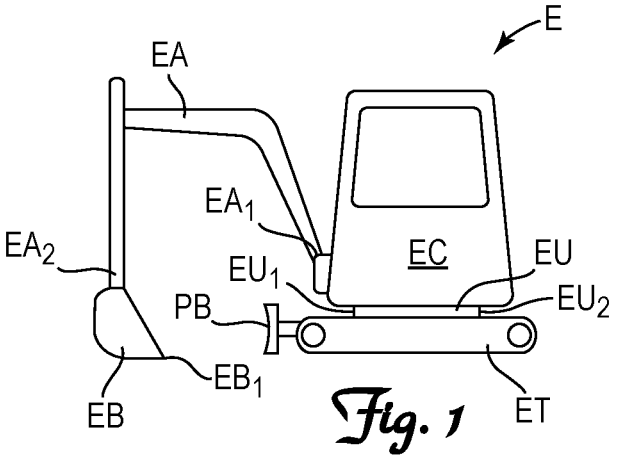
FIG. 1 is a side view of a prior art excavator equipped with a forward extending push blade.
Figure 2:
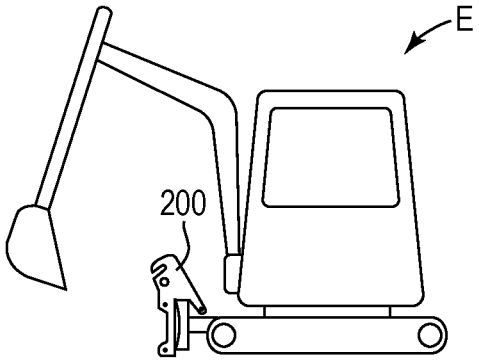
FIG. 2 is a side view of the excavator depicted in FIG. 1 equipped with a first embodiment of an attachment bracket in accordance with the invention secured to the push blade.
Figure 3:
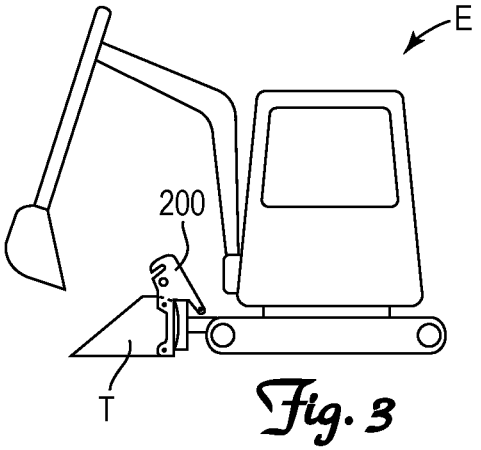
FIG. 3 is a side view of the excavator depicted in FIG. 2 with a bucket pinned to the attachment bracket.
Figure 4:
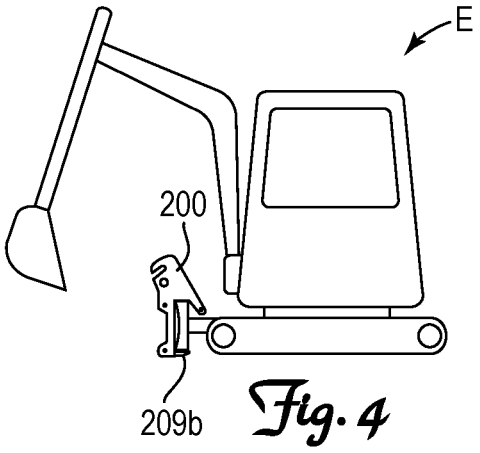
FIG. 4 is a side view of the excavator depicted in FIG. 1 equipped with a second embodiment of an attachment bracket in accordance with the invention secured to the push blade with a bucket pinned to the attachment bracket.
Figure 5:
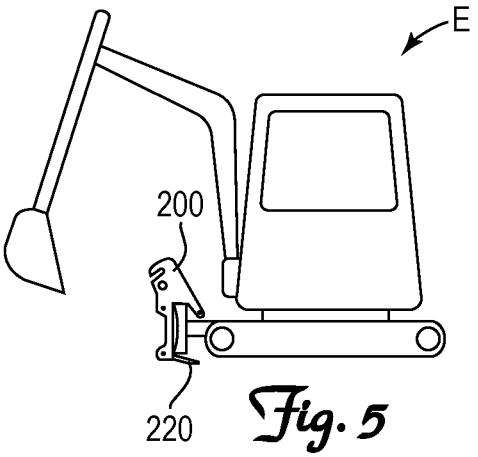
FIG. 5 is a side view of the excavator depicted in FIG. 1 equipped with a third embodiment of an attachment bracket in accordance with the invention secured to the push blade.
Figure 6:
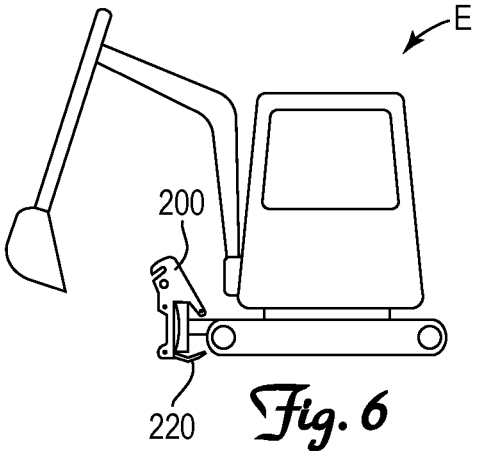
FIG. 6 is a side view of the excavator depicted in FIG. 1 equipped with a fourth embodiment of an attachment bracket in accordance with the invention secured to the push blade.
Figure 7:
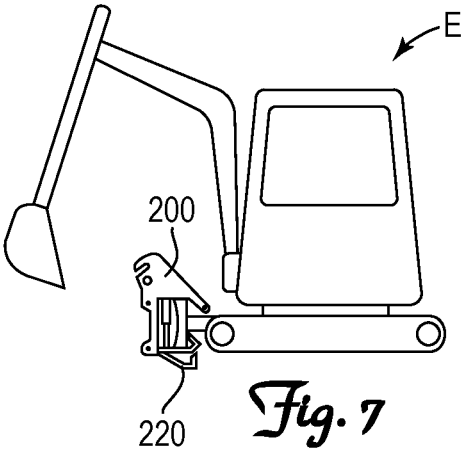
FIG. 7 is a side view of the excavator depicted in FIG. 1 equipped with fifth embodiment of an attachment bracket in accordance with the invention secured to the push blade.
Figure 8:
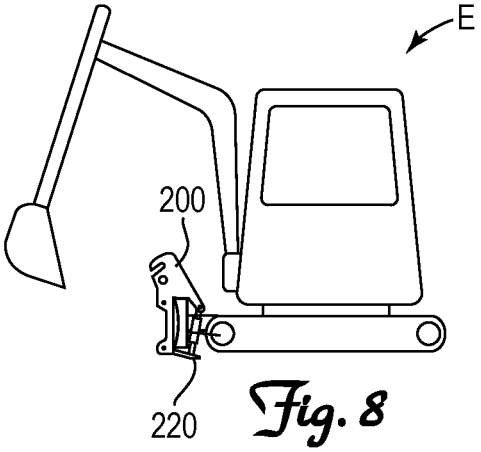
FIG. 8 is a side view of the excavator depicted in FIG. 5 with a turnbuckle for forced clamping of the attachment bracket onto the push blade.
Figure 9:
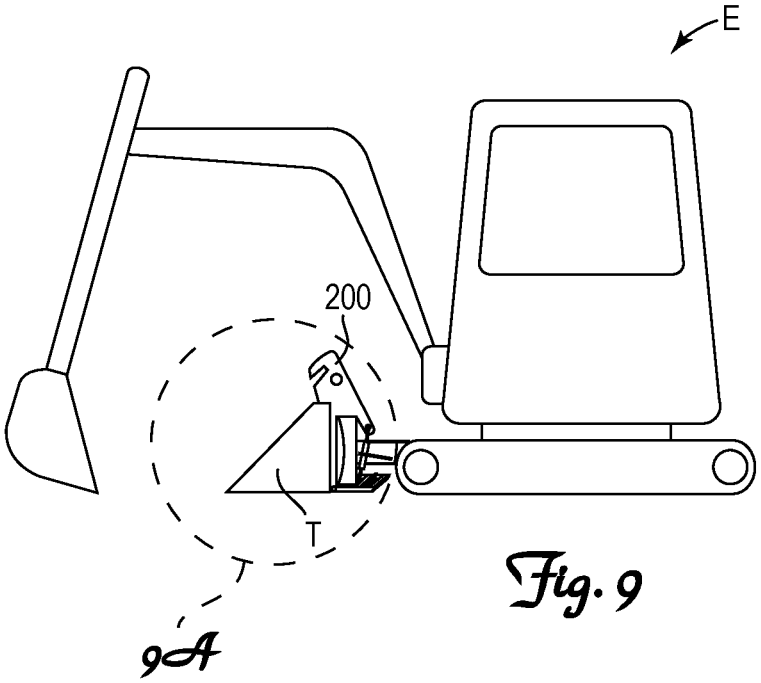
FIG. 9 is a side view of the excavator depicted in FIG. 8 with a bucket pinned to the attachment bracket.
Figure 9A:
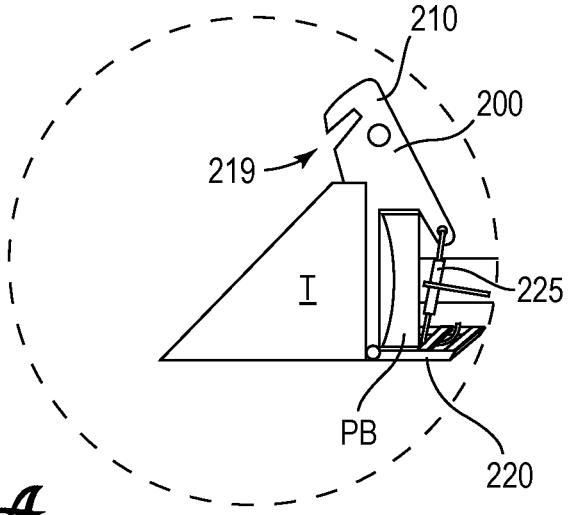
FIG. 9A is an enlarged side view of the push blade, attachment bracket and bucket depicted in FIG. 9.
Figure 12:
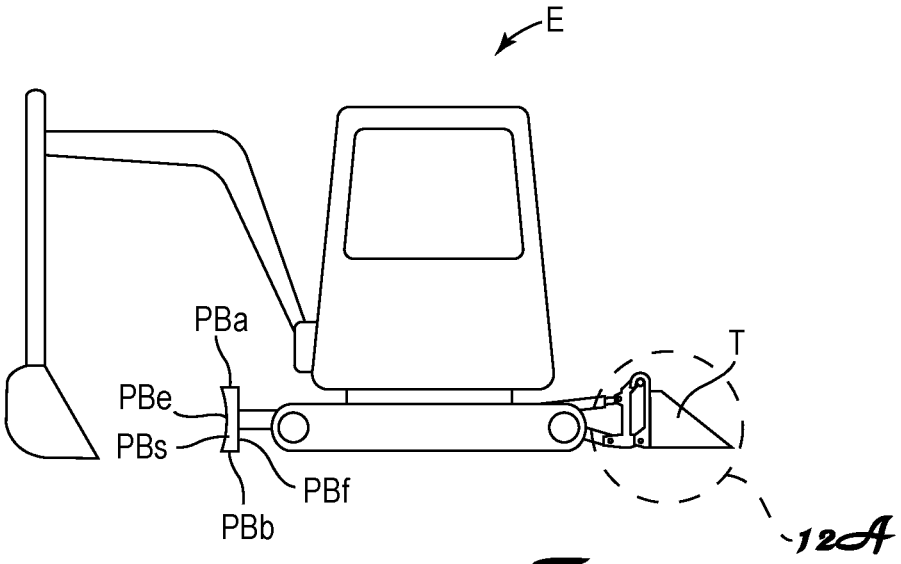
FIG. 12 is a side view of the excavator depicted in FIG. 1 with a first embodiment of an earth-moving tool mount and a bucket mounted onto a secondary arm extending from the rear of the excavator opposite the push blade.
Figure 12A:
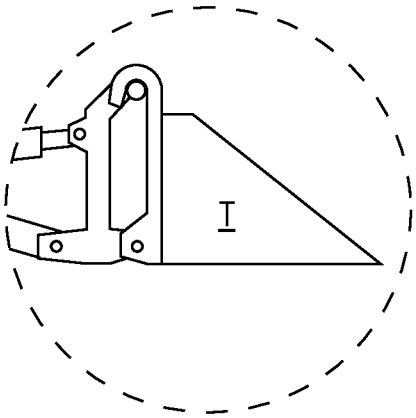
FIG. 12A is an enlarged side view of the earth-moving tool mount and bucket depicted in FIG. 12.
Figure 13:
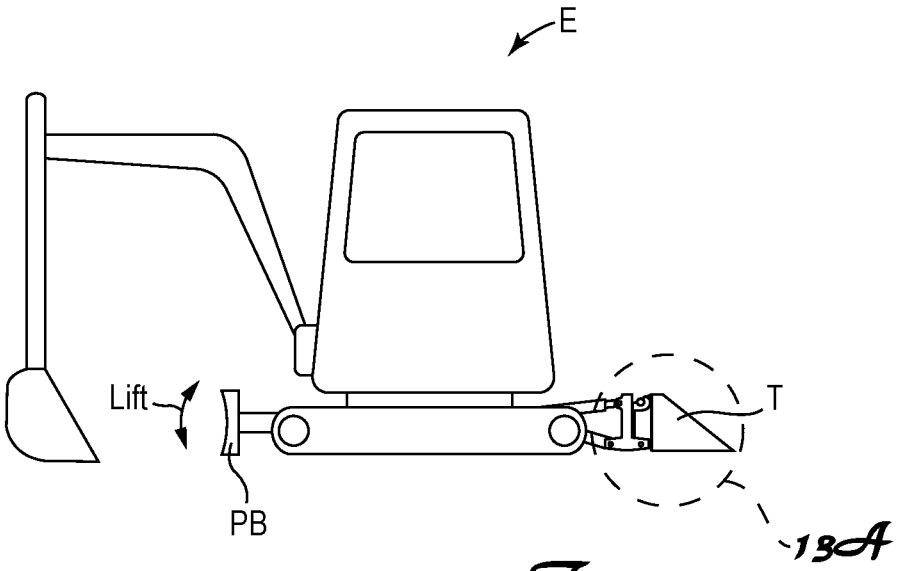
FIG. 13 is a side view of the excavator depicted in FIG. 1 with a second embodiment of a earth-moving tool mount and a bucket mounted onto a secondary arm extending from the rear of the excavator opposite the push blade.
Figure 13A:
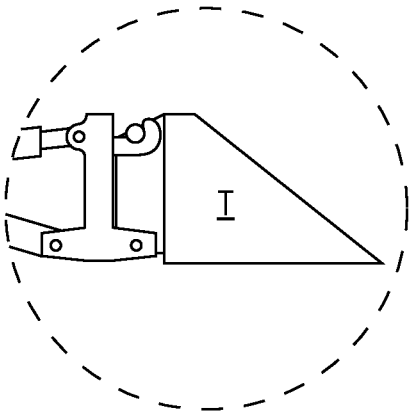
FIG. 13A is an enlarged side view of the earth-moving tool mount and bucket depicted in FIG. 13.
Figure 14:
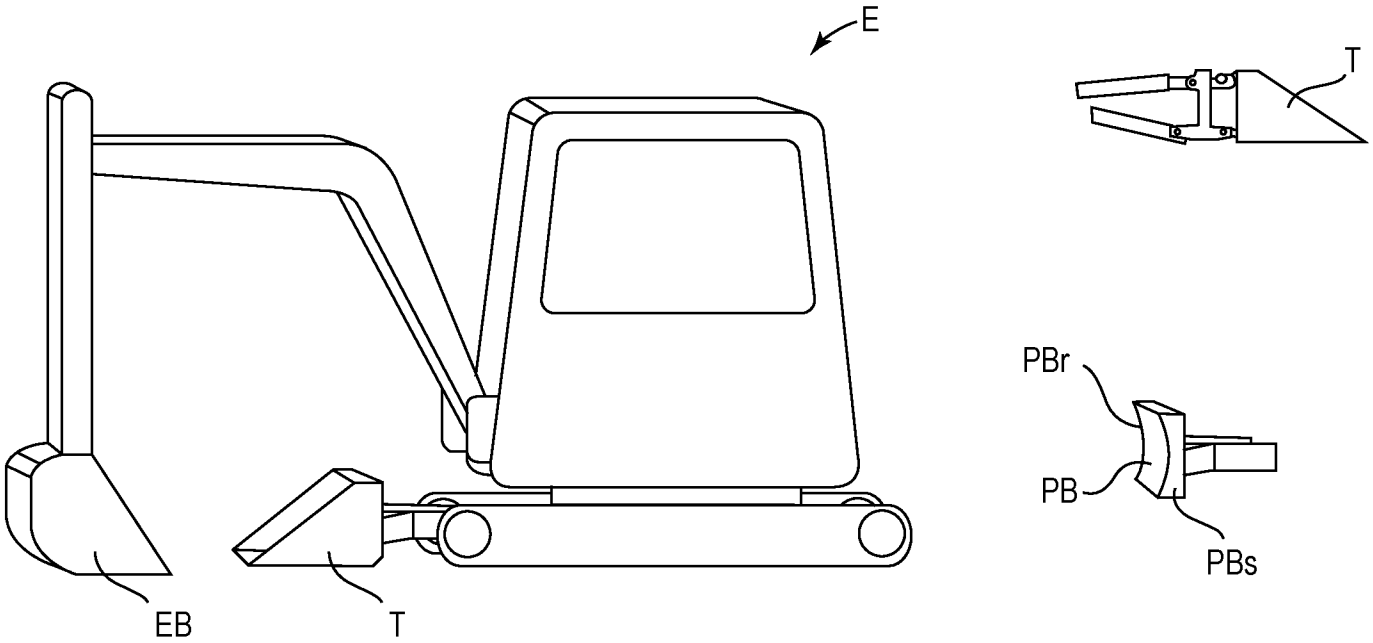
FIG. 14 is a perspective view of the excavator depicted in FIG. 1 depicted with a set of implements for alternative attachment to the lift arm on the excavator including a bucket, a earth-moving tool mount and mounted bucket, and a push blade.
Figure 15C:
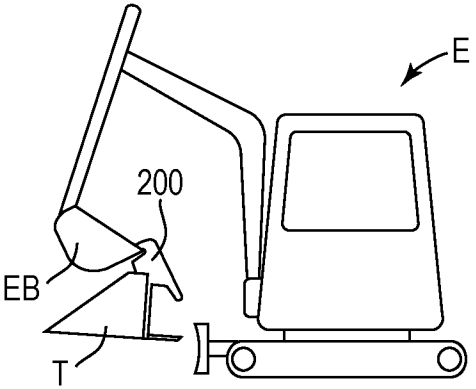
FIGS. 15A-F are a series of side views of the excavator depicted in FIG. 4 depicting sequential stages of mounting the attachment bracket with a bucket pinned thereto onto the push blade using the excavator bucket on the excavator.
Figure 15F:
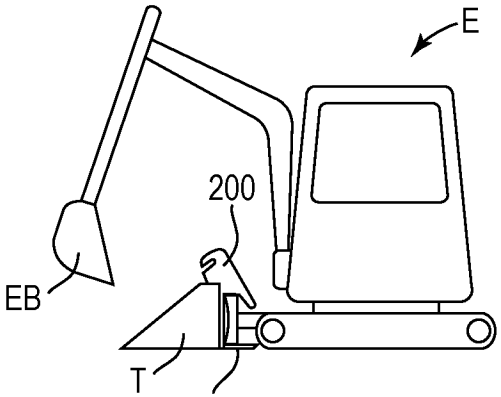
Figure 15B:
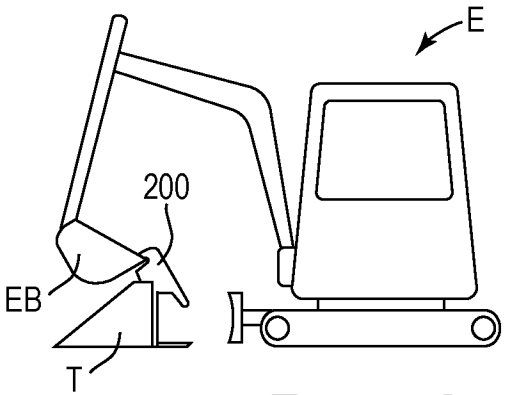
Figure 15E:
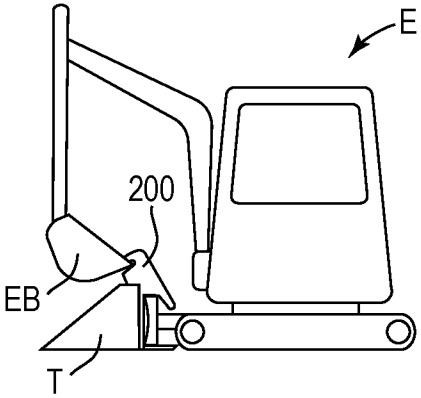
Figure 15A:
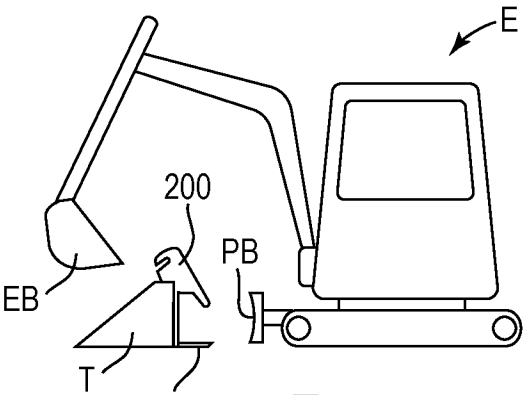
Figure 15D:
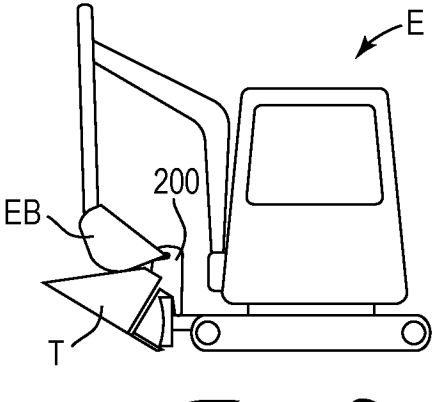
Figure 16A:
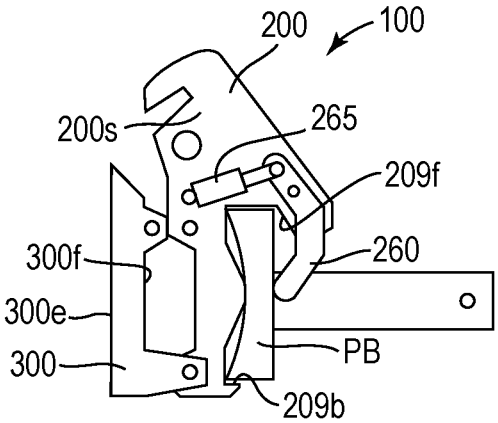
FIG. 16A is a side view of a sixth embodiment of an attachment bracket in accordance with the invention with a quick coupler pinned to the forward face of the attachment bracket and a push blade inserted into the cavity in the rearward face of the attachment bracket, with a locking lever pivoted into the clamping position.
Figure 16B:
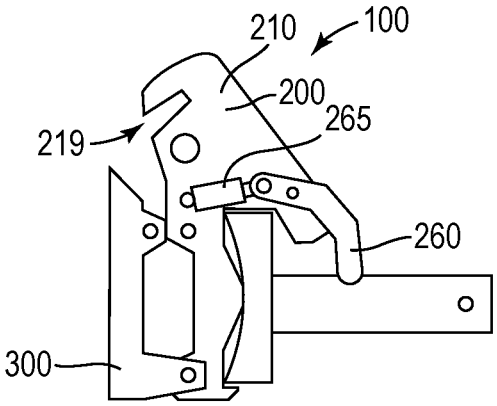
FIG. 16B is a side view of the attachment bracket depicted in FIG. 16A with the locking lever pivoted into the open position.
Figure 17A:
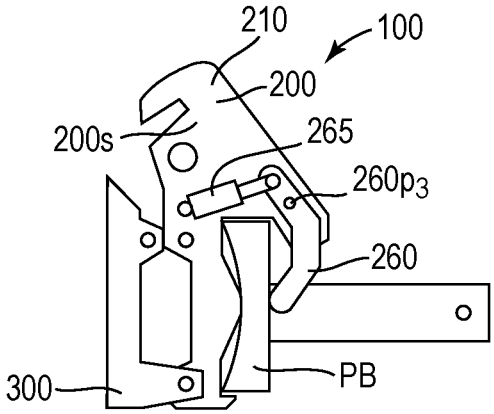
FIG. 17A is a side view of a seventh embodiment of an attachment bracket in accordance with the invention with a quick coupler pinned to the forward face of the attachment bracket and a push blade inserted into the cavity in the rearward face of the attachment bracket, with a locking lever pivoted into the clamping position.
Figure 17B:
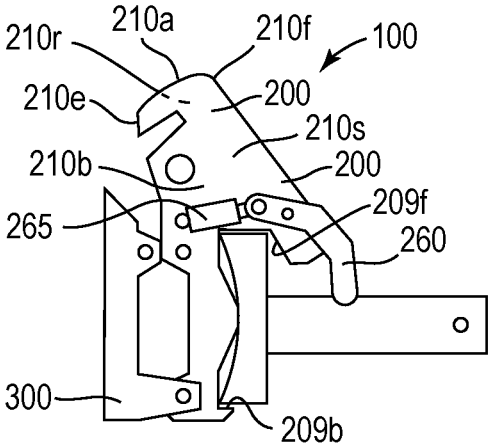
FIG. 17B is a side view of the attachment bracket depicted in FIG. 17A with the locking lever pivoted into the open position.

As utilized herein, including the claims, the term "attachment fixtures" means an appliance operable for stably but releasably securing an earth-moving tool to hydraulic earth-moving equipment, including specifically but not exclusively bores, hooks, notches, pins, aligned pin-accommodating orifices, rods, etc. and various combinations thereof.

As utilized herein, including the claims, the term "flexible line" means a flexible length of belt, cable, chain, cord, rope, strap or the like having sufficient structural integrity to endure use in connection with the earth-contacting components of heavy duty hydraulic earth-moving equipment.

Nomenclature Table

| REF. NO. | NAME |
|---|---|
| 100 | Adapter Bracket |
| 200 | Attachment Bracket |
| 200a | Top Edge of Attachment Bracket |
| 200b | Bottom Edge of Attachment Bracket |
| 200r | Right Side of Attachment Bracket |
| 200s | Left Side of Attachment Bracket |
| 200e | Forward Face of Attachment Bracket |
| 200f | Rearward Face of Attachment Bracket |
| $201_1$ | Upper Laterally Extending Support Rail |
| $201_2$ | Lower Laterally Extending Support Rail |
| 202r | Right Side Outer Member of Attachment Bracket |
| 202s | Left Side Outer Member of Attachment Bracket |
| 203r | Right Side Inner Member of Attachment Bracket |
| 203s | Left Side Inner Member of Attachment Bracket |
| 204r | Right Side Actuator Anchoring Stanchion of Attachment Bracket |
| 204s | Left Side Actuator Anchoring Stanchion of Attachment Bracket |
| 205 | Attachment Fixtures |
| 209 | Open Cavity in Rearward Face of Attachment Bracket |
| 209a | Top Wall Defining the Open Cavity |
| 209b | Bottom Lip Defining the Open Cavity |

-continued

Nomenclature Table

| REF. NO. | NAME |
|---|---|
| 209e | Forward Wall Defining Open Cavity |
| 209f | Rearward Lip Defining Open Cavity |
| 210 | Tab |
| 210a | Top End of Tab |
| 210b | Bottom End of Tab |
| 210r | Right Face of Tab |
| 210s | Left Face of Tab |
| 210e | Forward Edge of Tab |
| 210f | Rearward Edges of Tab |
| 219 | Notch in Forward Edge of Tab |
| 220 | Flange on Attachment Bracket |
| $220p_1$ | First Lateral Pivot Axis |
| 225 | Actuator for Pivoting Flange (e.g., turnbuckle or hydraulic cylinder) |
| 230 | Locking Lever on Attachment Bracket |
| $230p_2$ | Second Lateral Pivot Axis |
| 240 | Turnbuckle for Concomitant Pivoting of Flange and Locking Lever |
| $240_1$ | First End of Turnbuckle |
| $240_2$ | Second End of Turnbuckle |
| 250 | Flexible Line (e.g., chain or cable) |
| $250_1$ | First End of Flexible Line |
| $250_2$ | Second End of Flexible Line |
| 255 | Actuator for Tensioning Flexible Line (e.g., turnbuckle or hydraulic cylinder) |
| 260 | Compression Finger on Attachment Bracket |
| $260p_3$ | Third Lateral Pivot Axis |
| 265 | Actuator for Pivoting Compression Finger (e.g., hydraulic cylinder) |
| 270 | Shoe |
| $270p_4$ | Fourth Longitudinal Pivot Axis |
| $271_1$ | Support Plate of Shoe for Supporting Bottom Edge of Push Blade |
| $271_2$ | Retention Plate of Shoe for Engaging Rearward Face of Push Blade |
| 272 | Extension Plate on Shoe |
| 273 | Axle |
| 275 | Actuator for Pivoting Shoes (e.g., manually operated lever) |
| 300 | Quick Coupler |
| 300a | Top Edge of Quick Coupler |
| 300b | Bottom Edge of Quick Coupler |
| 300r | Right Side of Quick Coupler |
| 300s | Left Side of Quick Coupler |
| 300e | Forward Face of Quick Coupler |
| 300f | Rearward Face of Quick Coupler |
| $300p_5$ | Fifth Lateral Pivot Axis |
| 305 | Actuator for Pivoting Quick Coupler (e.g., hydraulic cylinder) |
| E | Excavator |
| EA | Excavator Arm |
| $EA_1$ | Proximal End of Excavator Arm |
| $EA_2$ | Distal End of Excavator Arm |
| EB | Excavator Bucket |
| $EB_1$ | Cutting Edge of Excavator Bucket |
| EC | Excavator Cab |
| ET | Excavator Track |
| EU | Undercarriage of Excavator |
| $EU_1$ | Forward End of Undercarriage |
| $EU_2$ | Rearward End of Undercarriage |
| EW | Excavator Wheels |
| PB | Push Blade |
| PBa | Top Edge of Push Blade |
| PBb | Bottom Edge of Push Blade |
| PBr | Right Side of Push Blade |
| PBs | Left Side of Push Blade |
| PBe | Forward Face of Push Blade |
| PBf | Rearward Face of Push Blade |
| T | Earth-Moving Tool |
| Lift | Lift |
| Tilt | Tilt |
| x | Longitudinal Front-to-Back Direction |
| y | Lateral Right-to-Left Direction |
| z | Transverse Top-to-Bottom Direction |

Construction

A first aspect of the invention is an attachment bracket 200 for use in operationally attaching an earth-moving tool T to a push blade PB on an excavator E.

Referring to FIG. 1, the excavator E includes an undercarriage EU having a forward end $EU_1$ and a rearward end $EU_2$, driven ground contacting left and rights tracks ET or wheels EW on the undercarriage EU, a cab EC mounted atop the undercarriage EU for rotation about a vertical axis relative to the undercarriage EU, an arm EA having a proximal end $EA_1$ attached for rotation with the cab EC and a distal end $EA_2$, a bucket EB having a cutting edge $EB_1$ pivotally attached to the distal end $EA_2$ of the arm EA for pivoting about a lateral y axis relative to the arm EA, and powered lift push blade PB extending forward from the undercarriage EU for pushing and leveling earth.

The excavator E can be a heavy-duty, compact or mini excavator.

The push blade PB has a top edge PBa, a bottom ground contact edge PBb, a right side PBr, a left side PBs, a forward face PBe facing away from the undercarriage EU and a rearward face PBf facing towards the undercarriage EU. The forward face PBe is typically curved about a lateral y axis. The push blade PB is typically hydraulically powered for both lift and side-to-side rotation about a vertical axis.

Referring to FIGS. 2-11 and 15-24, with particular reference to FIGS. 19 and 20-22 and 24, the attachment bracket 200 has a top edge 200*a*, a bottom edge 200*b*, a right side 200*r*, a left side 200*s*, a forward face 200*e* and a rearward face 200*f*. The forward face 200*e* presents attachment fixtures 205 operable for operational engagement with an earth-moving tool T. The rearward face 200*f* presents an open cavity 209 for accommodating insertion of the push blade PB into the cavity 209 for hanging attachment of the attachment bracket 200 onto the push blade PB.

The attachment bracket 200 needs to be constructed from a material having sufficient structural integrity to withstand the substantial compression, shear, stress and strain forces experienced by earth-working tools T attached to hydraulic earth-moving equipment, such as steel.

Figure 19:
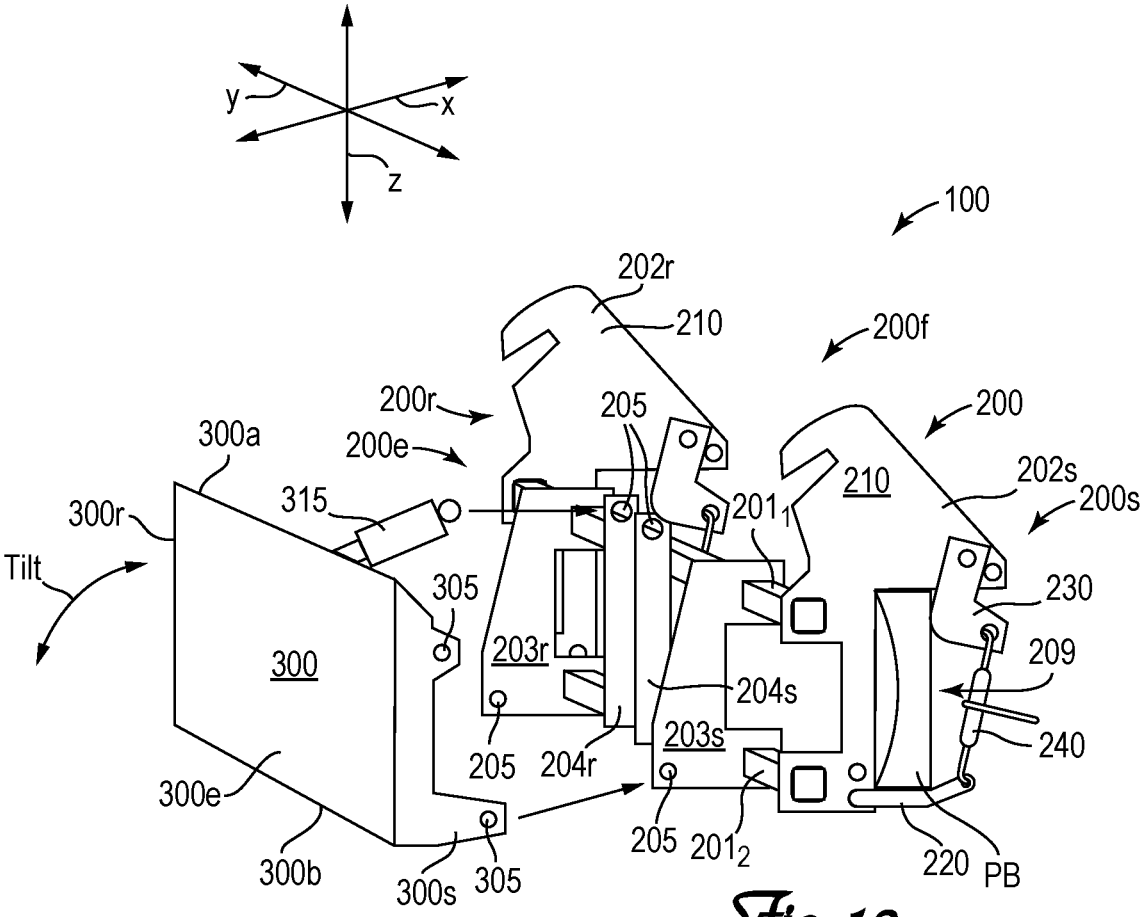
FIG. 19 is a perspective view of a ninth embodiment of an attachment bracket in accordance with the invention depicting an embodiment of a quick coupler in exploded view.

One particular embodiment of an attachment bracket 200, depicted in FIG. 19, includes upper and lower transversely z spaced laterally y extending support rails $\mathbf{201}_1$ and $\mathbf{201}_2$, laterally y spaced right and left side outer plates 202*r* and 202*s* attached to and extending longitudinally x rearward from the upper and lower support rails $\mathbf{201}_1$ and $\mathbf{201}_2$, laterally y spaced right and left side inner plates 203*r* and 203*s* attached to and extending longitudinally x forward from the upper and lower laterally y extending support rails $\mathbf{201}_1$ and $\mathbf{201}_2$, and a laterally y spaced pair of stanchions 204*r* and 204*s* attached to and extending longitudinally x forward from the upper and lower laterally y extending support rails $\mathbf{201}_1$ and $\mathbf{201}_2$.

The cavity 209 is cut into the right and left side outer plates 202*r* and 202*s* whereby the right and left side outer plates 202*r* and 202*s* provide attachment of the attachment bracket 200 to a push blade PB. Attachment fixtures 205 are provided on the right and left side inner plates 203*r* and 203*s* for use in attaching a quick coupler 300 or an earth-moving tool T to the attachment bracket 200. The pair of stanchions 204*r* and 204*s* provide attachment fixtures 205 proximate the upper end of the stanchions 204*r* and 204*s* for attachment of an actuator 305 operable to effect tilting of an attached quick coupler 300 or an earth-moving tool T.

Figure 20:
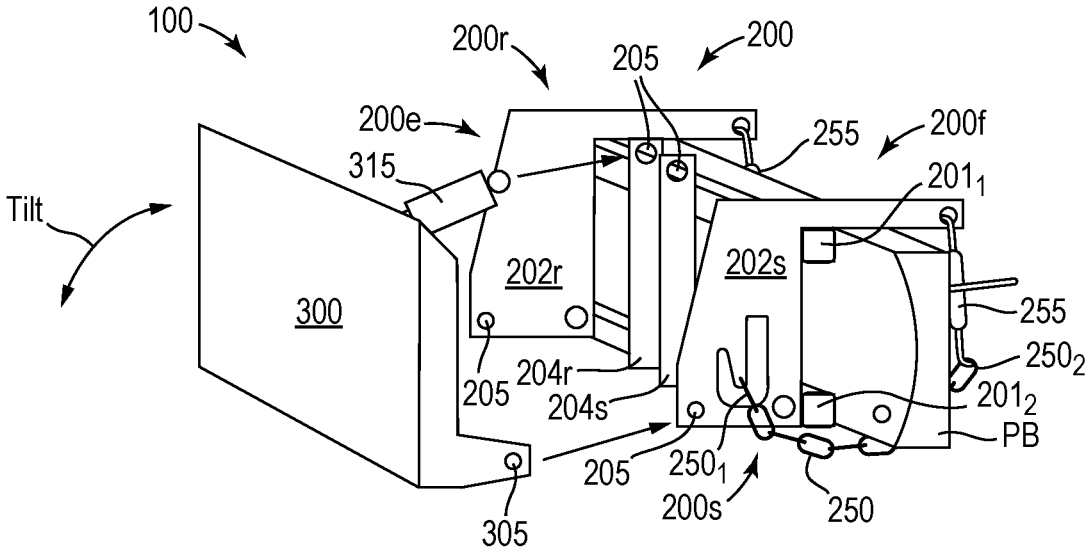
FIG. 20 is a perspective view of a tenth embodiment of an attachment bracket in accordance with the invention depicting an embodiment of a quick coupler in exploded view.
Figure 21:
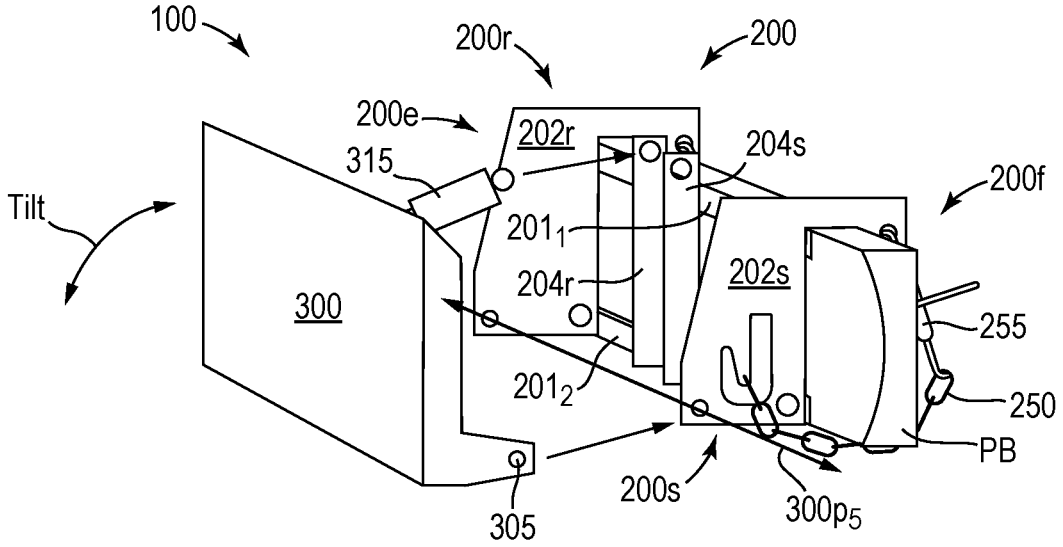
FIG. 21 is a perspective view of a less robust version of the attachment bracket and quick coupler depicted in FIG. 20.
Figure 22:
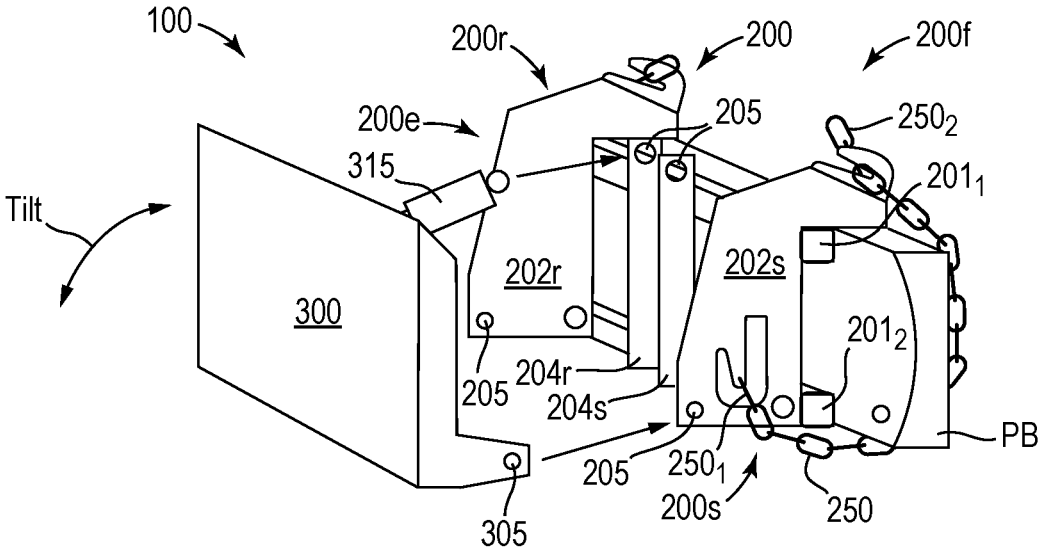
FIG. 22 is a perspective view of the attachment bracket and quick coupler depicted in FIG. 20 sans turnbuckle on the flexible line chain with the second end of the flexible line chain hooked within a slot in the attachment bracket.
Figure 23:
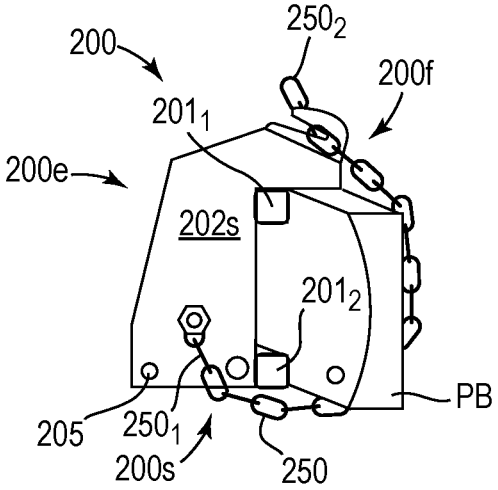
FIG. 23 is a partial perspective view of the attachment bracket depicted in FIG. 22 with the first end of the flexible line chain bolted to the attachment bracket.

Another particular embodiment of an attachment bracket 200, depicted in FIGS. 20-22, includes upper and lower transversely z spaced laterally y extending support rails $\mathbf{201}_1$ and $\mathbf{201}_2$, laterally y spaced right and left side outer plates 202*r* and 202*s* attached to and extending longitudinally x forward and rearward from the upper and lower support rails $\mathbf{201}_1$ and $\mathbf{201}_2$, and a laterally y spaced pair of stanchions 204*r* and 204*s* attached to and extending longitudinally x forward from the upper and lower laterally y extending support rails $\mathbf{201}_1$ and $\mathbf{201}_2$.

The cavity 209 is cut into the rearward facing edge (unnumbered) of each of the right and left side outer plates 202*r* and 202*s* whereby the right and left side outer plates 202*r* and 202*s* provide attachment of the attachment bracket 200 to a push blade PB. Attachment fixtures 205 are provided proximate the forward facing edge (unnumbered) of each of the right and left side outer plates 202*r* and 202*s* for use in attaching a quick coupler 300 or an earth-moving tool T to the attachment bracket 200. The pair of stanchions 204*r* and 204*s* provide attachment fixtures 205 proximate the upper end of the stanchions 204*r* and 204*s* for attachment of an actuator 305 operable to effect tilting of an attached quick coupler 300 or an earth-moving tool T.

Suitable attachment fixtures 205 include specifically but not exclusively orifices for alignment with corresponding orifices in a quick coupler 300 or an earth-moving tool T and accommodating insertion of pin(s), bars for accommodating hooks, notches or channels on a quick coupler 300 or an earth-moving tool T, hooks, notches or channels for hooking onto a bar on a quick coupler 300 or an earth-moving tool T, and combinations thereof.

The cavity 209 is rearwardly open for accommodating insertion of a push blade PB into cavity 209 from the rear of the cavity 209. The cavity 209 is defined by a top wall 209*a*, a forward wall 209*e* and a rearward extending lip 209*f* defining a hooking channel (unnumbered) at the top of the cavity 209. Referring to FIGS. 4, 15A-F, 16A-B, and 17A-B, a fixed position bottom lip 209*b* can be provided to assist in controlling transverse z shifting of a push blade PB retained within the cavity 209.

Referring to FIGS. 2-11, 15A-F, 16A-B, 17A-B, 18A-C and 19, the attachment bracket 200 can include one or more laterally y extending or laterally y spaced tabs 210 extending transversely z upward from the top edge 200*a* of the attachment bracket 200 for providing a forwarding facing notch 219 into which the cutting edge $EB_1$ of the excavator bucket EB can be inserted for allowing the excavator arm EA to lift and maneuver the attachment bracket 200 during mounting and dismounting of the attachment bracket 200 on the push blade PB as depicted in FIGS. 15A-F. Referring particularly to FIG. 19, a particular embodiment includes a pair of laterally y spaced planar tabs 210 each have a top end 210*a*, a bottom end 210*b*, a right face 210*r*, a left face 210*s*, a forward edge 210*e* and a rearward edge 210*f* with a notch 219 extending at a transverse z upward angle from the forward edge 210*e* of each tab 210.

Referring to FIGS. 5-11, 18A-C and 19, the attachment bracket 200 can include a laterally y extending flange 220 or set of laterally y spaced flanges 220 proximate the bottom edge 200*b* of the attachment bracket 200 below the cavity 209 and extending rearward from the rearward face 200*f* of the attachment bracket 200 for pivoting about a first lateral pivot axis $\mathbf{220}p_1$ as between an open position accommodating insertion and withdrawal of a push blade PB into and out from the cavity 209, and a closed position inhibiting withdrawal of a push blade PB in the cavity 209. In the closed position the flange(s) 220 can engage the bottom edge PBb of a push blade PB in the cavity 209 for limiting transverse z shifting of the push blade PB within the cavity 209 during use.

Referring to FIGS. 6, 7, 18A-C and 19, the flange 220 can be bent for cradling the bottom edge PBb of a push blade PB in the cavity 209 when the flange 220 is pivoted into the closed position.

Referring to FIGS. 8, 9-11, 18A-C and 19, the flange 220 can be selectively releasably forcibly pivoted into and locked in the closed position, such as with an actuator 225 exemplified by the turnbuckle or depicted in FIGS. 8-11 having one end secured to a distal end (unnumbered) of the flange 220 and the other end secured to the attachment bracket 200. Another suitable actuator 225 is a hydraulic cylinder (not shown) having one end secured to a distal end (unnumbered) of the flange 220 and the other end secured to the attachment bracket 200.

Figure 18A:
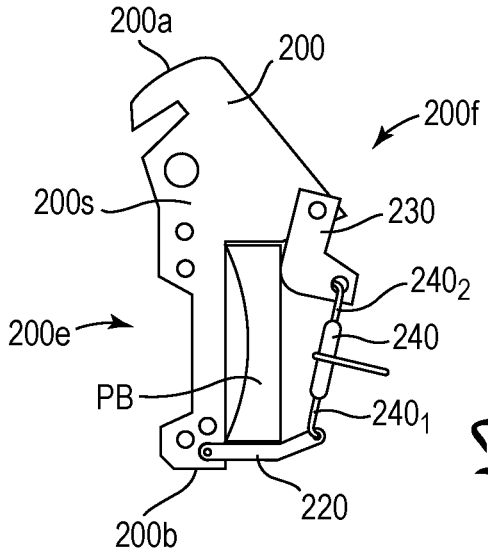
FIG. 18A-C are side views of an eighth embodiment of an attachment bracket in accordance with the invention having varying contours to the forward face of the attachment bracket.
Figure 18B:
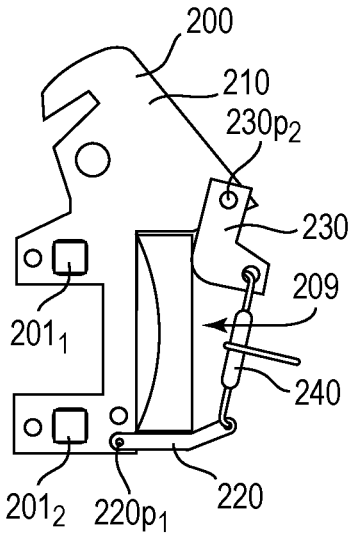
Figure 18C:
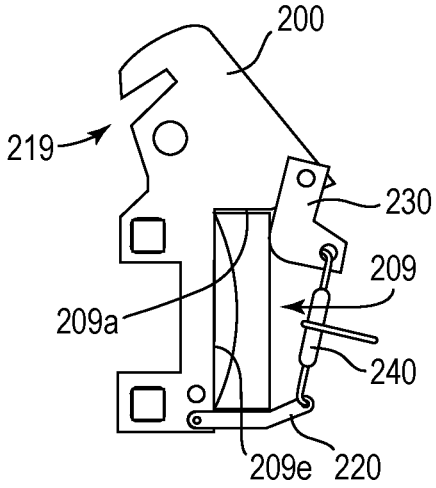

Referring to FIGS. 18A-C, the attachment bracket 200 can include a locking lever 230 pivotally attached to the attachment bracket 200 proximate the top edge 200*a* of the attachment bracket 200 and extending rearward of the cavity 209 for pivoting about a second lateral pivot axis $\mathbf{230}p_2$ as between an open position accommodating insertion and withdrawal of a push blade PB into and out from the cavity 209, and a closed position inhibiting withdrawal of a push blade PB in the cavity 209.

In the closed position the locking lever 230 can engage the rearward face PBf of a push blade PB in the cavity 209 for limiting longitudinal x shifting of the push blade PB within the cavity 209 during use.

As with pivoting of the flange 220, the locking lever 230 can be selectively releasably forcibly pivoted into and locked in the closed position, such as with an actuator 225 exemplified by the turnbuckle depicted in FIGS. 18A-C having one end $\mathbf{240}_1$ secured to a distal end (unnumbered) of the flange 220 and the other end $\mathbf{240}_2$ secured to the locking lever 230 offset rearward from the second lateral pivot axis $\mathbf{230}p_2$. Another suitable actuator 225 is a hydraulic cylinder (not shown) having one end secured to a distal end (unnumbered) of the flange 220 and the other end secured to the attachment bracket 200.

Referring to FIGS. 20-23, in addition to or instead of a pivotable flange 220, a push blade PB can be secured within the cavity 209 by a flexible line 250 such as a chain or cable wrapped underneath the push blade PB with first $\mathbf{250}_1$ and second $\mathbf{250}_2$ ends both detachably secured to the attachment bracket 200. When secured at both ends $\mathbf{250}_1$ and $\mathbf{250}_2$ to the attachment bracket 200 and the flexible line 250 extending underneath a push blade PB in the cavity 209, the push blade PB is prevented from falling out of the cavity 209 and transverse z shifting of the push blade PB within the cavity 209 is restricted.

The length of the flexible line 250 between the secured ends $\mathbf{250}_1$ and $\mathbf{250}_2$ can be selectively increased for facilitating attachment and detachment of the flexible line 250 to and from the attachment bracket 200 and decreased for compressing a push blade PB in the cavity 209 against the walls 209*a* and/or 209*e* of the cavity 209 with a manual or power actuated tensioning device exemplified by the turnbuckle 255 in-line with the flexible line 250 as depicted in FIGS. 20 and 21.

Referring to FIGS. 16A-B and 17A-B, the attachment bracket 200 can include a compression finger 260 pivotally attached to the attachment bracket 200 proximate the top edge 200*a* of the attachment bracket 200 and extending rearward of the cavity 209 for pivoting about a third lateral pivot axis $\mathbf{260}p_3$ as between an open position accommodating insertion and withdrawal of a push blade PB into and out from the cavity 209, and a closed position inhibiting withdrawal of a push blade PB in the cavity 209.

Figure 24:
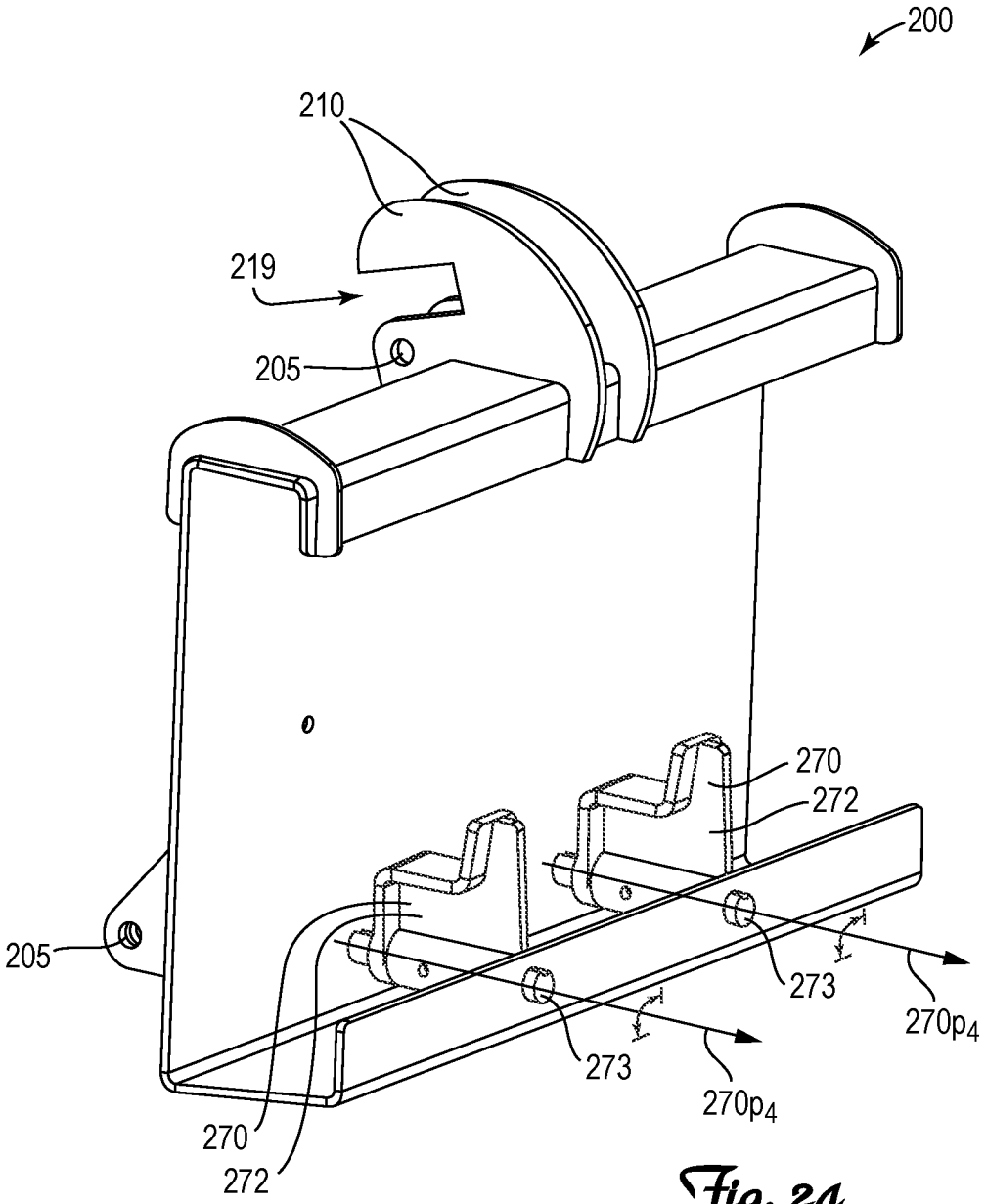
FIG. 24 is a perspective view of an eleventh embodiment of an attachment bracket in accordance with the invention.
Figure 25:
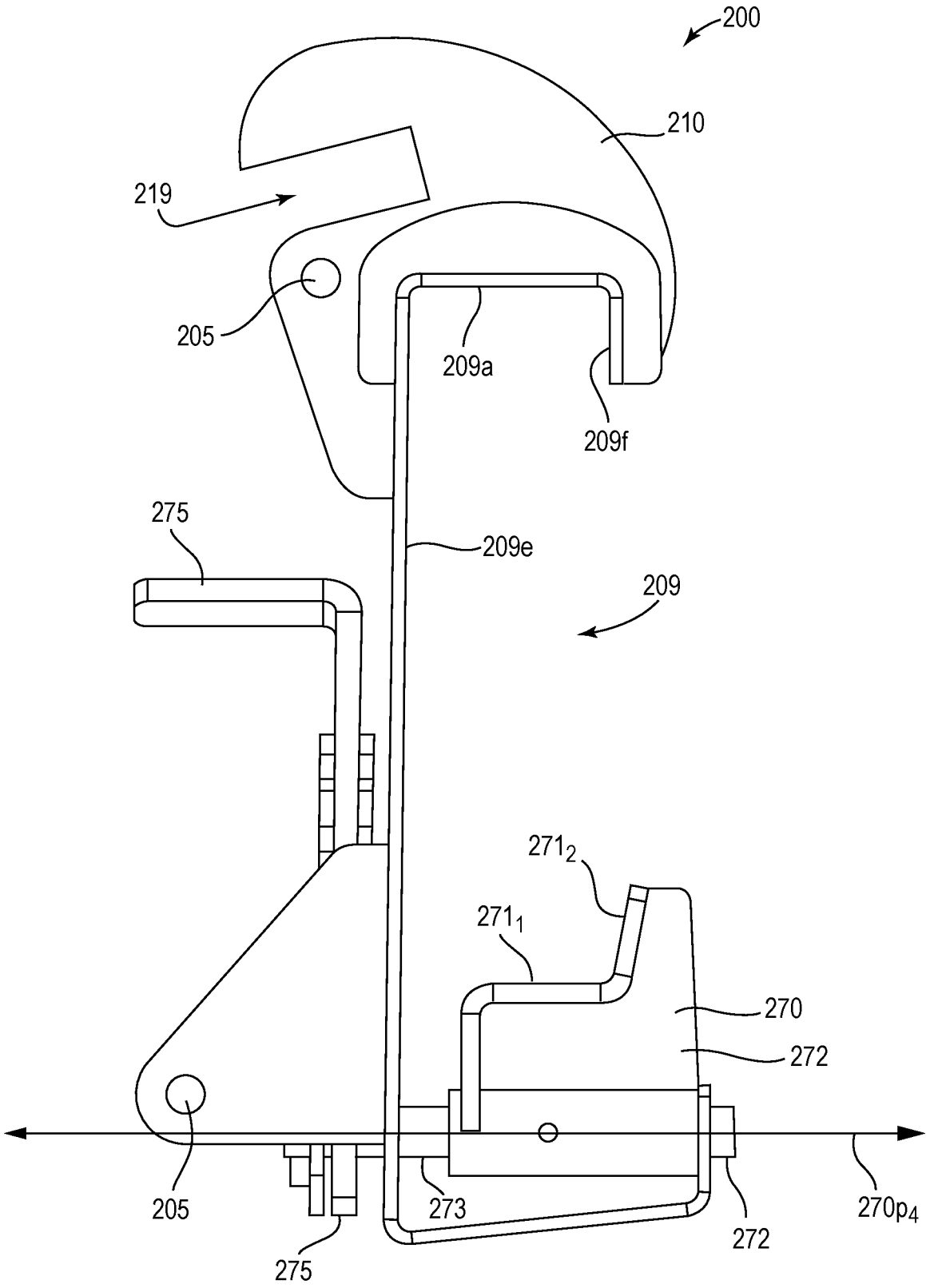
FIG. 25 is a side view of the attachment bracket depicted in FIG. 24.
Figure 26:
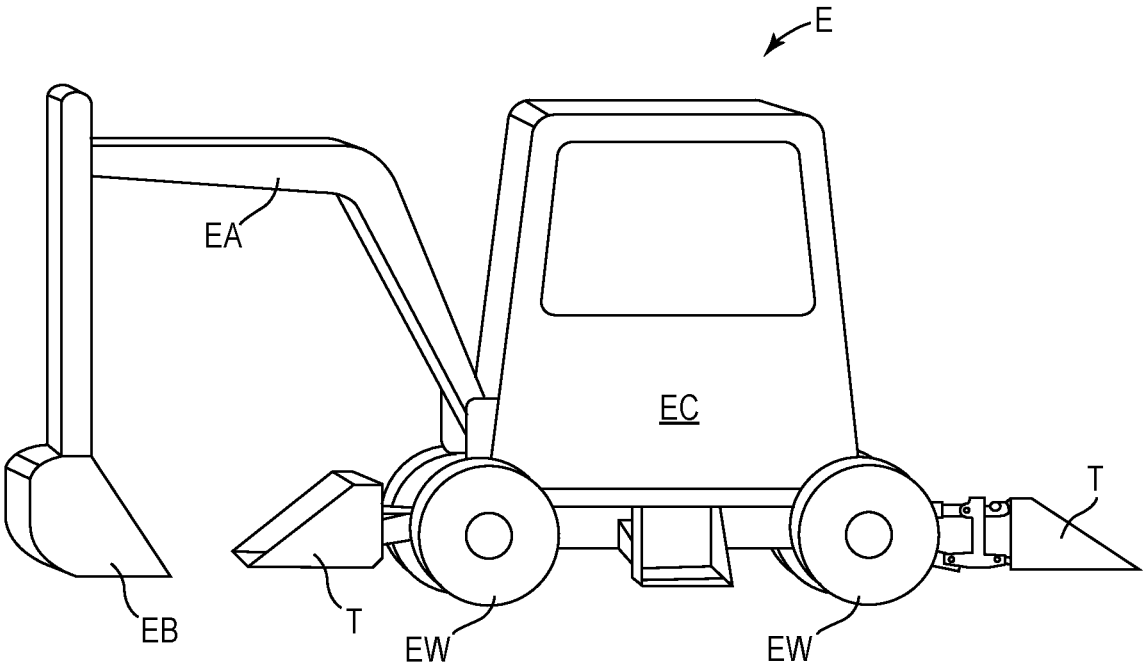
FIG. 26 is a perspective view of a wheeled version of the excavator depicted in FIG. 14.

Referring to FIGS. 24 and 25, the attachment bracket 200 can include one or more shoes 270 proximate the bottom of the cavity 209 for rotation about a fourth longitudinal pivot axis $\mathbf{270}p_4$ as between a laterally y projecting open position for accommodating insertion and withdrawal of a push blade PB into and out from the cavity 209, and a transversely z projecting closed position for inhibiting withdrawal of a push blade PB within the cavity 209. Each shoe 270 can be mounted for rotation with an axle 273, with a support plate $\mathbf{271}_1$ operable for supporting the bottom edge PBb of a push blade PB retained within the cavity 209 and preferably pressing the top edge PBa of the push blade PB against the top wall 209*a* defining the cavity 209 when the shoe 270 is rotated into the closed position, and a retention plate $\mathbf{271}_2$ operable for engaging the rearward face PBf of a push blade PB retained within the cavity 209 and preferably pressing the forward face PBe of the push blade PB against the forward wall 209*e* defining the cavity 209 when the shoe 270 is rotated into the closed position. An extension plate 272 on each shoe 270 spaces the support plate $\mathbf{271}_1$ and retention plate $\mathbf{271}_2$ a distance away from the fourth longitudinal pivot axis $\mathbf{270}p_4$ so that the transverse z distance between the support and retention plates $\mathbf{271}_1$, $\mathbf{271}_2$ and the top wall 209 defining the cavity 209 (*i*) increases as the shoes 270 are rotated towards the open position for accommodating longitudinal x insertion of a push blade PB into the cavity 209, and (ii) decreases as the shoes 270 are rotated towards the closed position for securing the push blade PB within the cavity 209 and preferably clamping the push blade PB against the top 209*a* and/or forward 209*e* walls defining the cavity 209.

An actuator 275, exemplified by the manually operated lever positioned forward the forward face 200*e* of the attachment bracket 200, is provided for rotating the axle(s) 273 and thereby the shoe(s) 270 mounted thereon between the open and closed positions.

In the closed position the compression finger 260 can engage the rearward face PBf of a push blade PB in the cavity 209 for limiting longitudinal x shifting of the push blade PB within the cavity 209 during use.

As with pivoting of the flange 220, the compression finger 260 can be selectively releasably forcibly pivoted into and locked in the closed position, such as with an actuator 265 exemplified by the hydraulic cylinder depicted in FIGS. 16A-B and 17A-B having one end secured to a proximal end (unnumbered) of the compression finger 260 and the other end secured to the attachment bracket 200.

A second aspect of the invention is an adapter bracket 100 for use in operationally attaching an earth-moving tool T equipped with a skid steer quick attaching system to a push blade PB on an excavator E.

Referring to FIGS. 10, 10A, 11, 11A, 16A-B, 17A-B, 19, 20, 21 and 22, the adapter bracket 100 includes an attachment bracket 200 in accordance with the first aspect of the invention and a quick coupler 300.

Referring to FIGS. 10, 10A, 11, 11A, 16A-B, 17A-B, 19, and 20-23, with particular reference to FIGS. 19-22, the quick coupler 300 has a top edge 300*a*, a bottom edge 300*b*, a right side 300*r*, a left side 300*s*, a forward face 300*e* and a rearward face 300*f*. The rearward face 300*f* presents attachment fixtures 305 mated to the attachment fixtures 205 on the forward face 200*e* of the attachment bracket 200 for operational engagement of the quick coupler 300 onto the attachment bracket 200.

Suitable attachment fixtures 305 include specifically but not exclusively orifices for alignment with corresponding orifices in an attachment bracket 200 and accommodating insertion of pin(s), bars for accommodating hooks, notches or channels on an attachment bracket 200, hooks, notches or channels for hooking onto a bar on an attachment bracket 200, and combinations thereof.

In a preferred embodiment, the bottom of the quick coupler 300 is pivotally attached to the attachment bracket 200 for pivoting about a fourth lateral y pivot axis $\mathbf{300}p_5$ with the top of the quick coupler 300 attached to the attachment bracket 200 via an actuator 305 such as a powered hydraulic cylinder to effect tilt pivoting of the quick coupler 300 about the fourth lateral y pivot axis $\mathbf{300}p_5$.

The quick coupler 300 is secured to the forward face 200*e* of the attachment bracket 200 and has a top beveled edge 300*a* operable for insertion into a downwardly open channel (not shown) extending from a rearward face (not shown) of an earth-moving tool T equipped with a skid steer quick attaching system accommodating insertion of the upper beveled edge 300*a* into the channel for hanging attachment of the earth-moving tool T onto the quick coupler 300.

Referring to FIGS. 12, 12A, 13, 13A, 14 and 26, a third aspect of the invention is an excavator E equipped with the first and/or second aspects of the invention, including specifically but not exclusively an excavator E equipped with a first earth-moving tool T mounted on a push blade PB extending from the forward end of the undercarriage $EU_1$ and a second earth-moving tool T extending rearward from the undercarriage $EU_2$, both having powered Lift and Tilt functionality.

Attachment

Referring to FIGS. 15A-F, an attachment bracket 200 having a tab 210, with or without an attached quick coupler 300 and/or an earth-moving tool T, can be conveniently mounted onto the push blade PB of an excavator E using the excavator bucket EB by (i) positioning any of a pivoting flange 220, locking lever 230, flexible line 250 and compression finger 260 on the attachment bracket 200 into the open or disengaged position, (ii) engaging the cutting edge $EB_1$ of the excavator bucket EB within the notch 219 in the tab 210 (FIG. 15B), (iii) lifting the attachment bracket 200 with the excavator arm EA (FIG. 15C), (iv) maneuvering the attachment bracket 200 to position the push blade PB within the cavity 209 on the attachment bracket 200 (FIGS. 15D and 15E), and (v) removing the cutting edge $EB_1$ of the excavator bucket EB from the notch 219 in the tab 210 (FIG. 15F) whereby the attachment bracket 200 hangs from the push blade PB. Once hung, each of the pivoting flange 220, locking lever 230, flexible line 250 and/or compression finger 260 on the attachment bracket 200 can be repositioned into the closed or engaged position to secure the attachment bracket 200 to the push blade PB.

I claim:

1. An attachment bracket for use in operationally attaching an earth-moving tool to a push blade on an excavator having an excavator bucket with a cutting edge mounted on an excavator arm of the excavator, the attachment bracket (A) having forward and rearward faces and presenting (i) an open cavity in the rearward face for accommodating insertion of the push blade into the cavity for hanging attachment of the attachment bracket onto the push blade, and (ii) attachment fixtures accessible from the forward face operable for operational engagement with the earth-moving tool, and (B) including a flange extending rearward from the rearward face of the attachment bracket for engaging the lower edge of a push blade inserted into the cavity for limiting transverse shifting of the push blade within the cavity during use, wherein the flange is pivotable about a lateral pivot axis as between an open position accommodating insertion and withdrawal of the push blade into and out from the cavity, and a closed position inhibiting withdrawal of the push blade out from the cavity.

2. The attachment bracket of claim 1 wherein the flange is bent for cradling a bottom edge of a push blade inserted into the cavity when the flange is pivoted into the closed position.

3. The attachment bracket of claim 1 wherein the flange is selectively releasably lockable in the closed position.

4. The attachment bracket of claim 1 further comprising a locking lever pivotably mounted to the attachment bracket above the cavity in the attachment bracket for pivoting about a lateral pivot axis as between an open position accommodating insertion and withdrawal of a push blade into and out from the cavity, and a closed position whereby the locking lever is situated for abutting a rearward face of a push blade inserted into the cavity to inhibit withdrawal of the inserted push blade out from the cavity.

5. The attachment bracket of claim 1 further comprising an actuator for selective forced pivoting of the flange into the closed position to effect compression of a push blade inserted into the cavity between the flange and the attachment bracket.

6. The attachment bracket of claim 4 further comprising a manually actuated turnbuckle having a first end secured to the flange and a second end secured to the locking lever for effecting selective forced concomitant pivoting of both the flange and the locking lever towards the closed position to effect compression of a push blade inserted into the cavity between the flange and the attachment bracket and between the locking lever and the attachment bracket.

7. The attachment bracket of claim 5 wherein the actuator is a manually actuated turnbuckle having a first end secured to the flange and a second end secured to the attachment bracket.

8. The attachment bracket of claim 1 further comprising a tab secured to and extending vertically upward above the attachment bracket with a notch in the forward facing edge of the tab configured and arranged for accepting insertion of the cutting edge of the excavator bucket on the excavator arm of the excavator for lifting and maneuvering the attachment bracket to effect mounting and dismounting of the attachment bracket onto the push blade.

9. The attachment bracket of claim 1 further comprising a flexible line having a first end detachably secured to the attachment bracket forward of the cavity and a second end detachably secured to the attachment bracket rearward of the cavity, the flexible line having a length operable for extending underneath a push blade inserted onto the cavity for limiting transverse shifting of the push blade within the cavity when both ends of the flexible line are secured to the attachment bracket.

10. The attachment bracket of claim 9 further comprising an actuator for selective tensioning of the flexible line to constrain the push blade within the cavity and thereby limit vertical shifting of the push blade within the cavity during use.

11. The attachment bracket of claim 10 wherein the actuator is a manually actuated turnbuckle.

12. An excavator with an undercarriage having forward and rearward ends, an excavator arm extending forward from the forward end of the undercarriage, an excavator bucket with a cutting edge mounted on a distal end of the excavator arm, and a push blade extending forward from the forward end of the undercarriage, the excavator equipped with an attachment bracket in accordance with claim 1 for use in operationally attaching an earth-moving tool to the push blade.

13. The excavator of claim 12 further equipped with an earth-moving tool extending rearward from the rearward end of the undercarriage having powered lift and tilt.

14. An adapter bracket for use in operationally attaching a earth-moving tool to a push blade on an excavator having an excavator bucket with a cutting edge mounted on an excavator arm of the excavator, comprising:

(a) an attachment bracket (A) having forward and rearward faces and presenting an open cavity in the rearward face for accommodating insertion of the push blade into the cavity for hanging attachment of the bracket onto the push blade, and (B) including a compression finger pivotably mounted to the attachment bracket above the cavity in the attachment bracket for pivoting about a lateral pivot axis as between an open position accommodating insertion and withdrawal of a push blade into and out from the cavity, and a closed position whereby the compression finger is situated for abutting a rearward face of a push blade inserted into the cavity to inhibit withdrawal of the inserted push blade out from the cavity, and (b) a quick coupler secured to the forward face of the attachment bracket and having a top beveled edge operable for insertion into a downwardly open channel extending from a rearward face of the earth-moving tool for accommodating insertion of the upper beveled edge into the channel for hanging attachment of the earth-moving tool onto the quick coupler.

15. The adapter bracket of claim 14 wherein the quick coupler is pinned to the attachment bracket.

16. The adapter bracket of claim 14 wherein the quick coupler is pivotably pinned to the attachment bracket proximate a bottom edge of the quick coupler for pivoting of the quick coupler relative to the attachment bracket about a lateral pivot axis, and secured to the attachment bracket proximate the top edge of the quick coupler via a hydraulic cylinder for selectively actuating pivoting of the quick coupler relative to the attachment bracket about the lateral pivot axis for tilting of the quick coupler and any earth-moving tool attached thereto.

17. The adapter bracket of claim 14 further comprising a hydraulic cylinder connected at a first end to the attachment bracket and at a second end to the compression finger for selectively pivoting the compression finger between the open and closed positions whereby the compression finger is operable to actively and forcibly clamp a push blade inserted within the cavity against the rearward facing of the attachment bracket when pivoted into the closed position.

18. An excavator with an undercarriage having forward and rearward ends, an excavator arm extending forward from the forward end of the undercarriage, an excavator bucket with a cutting edge mounted on a distal end of the excavator arm, and a push blade extending forward from the forward end of the undercarriage, the excavator equipped with an adapter bracket in accordance with claim 14 for use in operationally attaching an earth-moving tool to the push blade of the excavator.

19. The excavator of claim 18 further equipped with an earth-moving tool extending rearward from the rearward end of the undercarriage having powered lift and tilt.

* * * * *